US006606070B2

(12) United States Patent
Olson et al.

(10) Patent No.: US 6,606,070 B2
(45) Date of Patent: Aug. 12, 2003

(54) TUNABLE ANTENNA FOR RF METERING NETWORKS

(75) Inventors: John A. Olson, Brookfield, WI (US); Mark Lazar, New Berlin, WI (US); H. Paul Walding, Jr., Slinger, WI (US)

(73) Assignee: Badger Meter, Inc., Milwaukee, WI (US)

( * ) Notice: Subject to any disclaimer, the term of this patent is extended or adjusted under 35 U.S.C. 154(b) by 0 days.

(21) Appl. No.: 10/052,867

(22) Filed: Nov. 7, 2001

(65) Prior Publication Data

US 2003/0085844 A1 May 8, 2003

(51) Int. Cl.[7] ..... H01Q 1/38

(52) U.S. Cl. ..... 343/745; 340/870.02; 340/870.01

(58) Field of Search ..... 343/745, 746, 343/702, 749, 700 MS; 340/870.02, 870.31, 825.54; 324/156; 73/273

(56) References Cited

U.S. PATENT DOCUMENTS

| | | | | |
|---|---|---|---|---|
| 4,070,676 | A | 1/1978 | Sanford | 343/700 MS |
| 4,401,988 | A | 8/1983 | Kaloi | 343/700 MS |
| 4,835,540 | A | 5/1989 | Haruyama et al. | 343/700 MS |
| 5,270,704 | A | 12/1993 | Sosa Quintana et al. | 340/870.02 |
| 5,298,894 | A | 3/1994 | Cernv et al. | 340/870.02 |
| 5,416,475 | A | 5/1995 | Tolbert et al. | 340/870.02 |
| 5,519,387 | A | 5/1996 | Besier et al. | 340/870.02 |
| 5,583,492 | A | 12/1996 | Nakanishi et al. | 340/87.02 |
| 5,621,419 | A | 4/1997 | Meek et al. | 343/770 |
| 5,703,601 | A | 12/1997 | Nalbandian et al. | 343/700 MS |
| 5,825,303 | A | 10/1998 | Bloss, Jr. et al. | 340/870.02 |
| 5,877,703 | A | 3/1999 | Bloss, Jr. et al. | 340/870.02 |
| 6,166,692 | A | 12/2000 | Nalbandian et al. | 343/700 MS |
| 6,292,152 | B1 * | 9/2001 | Cosenza et al. | 343/745 |
| 6,300,907 | B1 | 10/2001 | Lazar et al. | 343/700 MS |

* cited by examiner

*Primary Examiner*—James Clinger
(74) *Attorney, Agent, or Firm*—Quarles & Brady LLP

(57) ABSTRACT

An antenna assembly (10) for RF communication of signals representing utility meter data. The antenna assembly (10) comprises a first conductor (30) forming at least a portion of an antenna radiating element, a second conductor (28), and a dielectric (34) disposed between the first conductor (30) and the second conductor (28), such that the first conductor (30), the second conductor (28) and the dielectric (34) form a capacitor. The antenna assembly (10) further comprises an inductance (36) in cascade with the capacitor to provide a selected L-C circuit impedance in relation to the antenna radiating element. The second conductor (28) is disposed opposite to the first conductor (30) and at least one of the first and second conductors (28, 30) is movable from a first to a second position to adjust the capacitance of the L-C circuit to a selected frequency of operation.

24 Claims, 3 Drawing Sheets

TUNABLE ANTENNA FOR RF METERING NETWORKS

TECHNICAL FIELD

The invention relates to utility meter transmitter assemblies for use in RF metering networks.

DESCRIPTION OF THE BACKGROUND ART

In recent years, the desire to automate collection and billing of utility consumption data has led to the introduction of various metering networks, including RF networks in which data is collected from fixed transmitting stations which are connected to one or meters for metering gas, electricity or water usage.

As further disclosed in Cerny et al., a radio frequency (RF) transmitter may transmit signals representing meter consumption data to a mobile collection unit which may be carried in a vehicle or which may be carried by a person. Radio frequency transmitters may also be used to transmit signals from stationary transmitting units to stationary data collection units at specific locations. In this type of system, it has become necessary to provide transmitters and antennae with greater power and greater range than in prior art equipment.

Examples of prior art transmitters and antennae are disclosed in Cerny et al., U.S. Pat. No. 5,298,894, and Bloss et al., U.S. Pat. No. 5,877,703. Cerny et al. discloses that the antenna assembly can be separate from, or integrated with, the transmitter assembly.

It is also desirable to make the antenna assemblies compact in size, low in cost of manufacture, durable and easy to install and service.

SUMMARY OF THE INVENTION

The invention relates to an antenna assembly for RF utility metering equipment, and particularly to an antenna assembly including a capacitance which can be tuned to provide a selected operating frequency. The invention also relates to a method of making such an assembly.

More specifically, the present invention is an antenna assembly for RF communication of signals representing utility meter data. The antenna assembly comprises a first conductor forming at least a portion of an antenna radiating element, a second conductor, and a dielectric disposed between the first conductor and the second conductor, such that the first conductor, the second conductor and the dielectric form a capacitor. The antenna assembly further comprises an inductance in cascade with the capacitor to provide a selected L-C circuit impedance in relation to the antenna radiating element. The second conductor is disposed opposite to the first conductor and at least one of the first and second conductors is movable from a first to a second position to adjust the capacitance of the L-C circuit to a selected frequency of operation.

It is one object of the invention to provide the ability to tune the frequency of the antenna for increased accuracy and decreased manufacturing costs as compared to prior art devices.

It is another object of the invention to provide an antenna assembly in which each of the first and second conductors includes a plurality of apertures alternating with portions of conductive material, and wherein a misalignment of the apertures in the respective conductors adjusts the capacitance to tune the L-C circuit It is yet another object of the invention to provide apertures in the first and second conductors that are formed as 45-degree sectors alternated with 45-degree sectors of conductive material.

It is still another object of the invention to provide apertures in the first and second conductors which are arranged symmetrically to provide a symmetrical radiation pattern.

A still further object of the invention to provide a variable capacitance to tune the antenna assembly to an operating frequency of substantially 915 MHz.

Yet a still further object of the invention is to provide a variable capacitance to tune the antenna assembly to a frequency between 820 MHz and 1.2 GHz.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention. Such examples, however, are not exhaustive of the various embodiments of the invention, and therefore, reference is made to the claims which follow the description for determining the scope of the invention.

DETAILED DESCRIPTION OF THE PREFERRED AND ALTERNATIVE EMBODIMENTS

Figure 1:
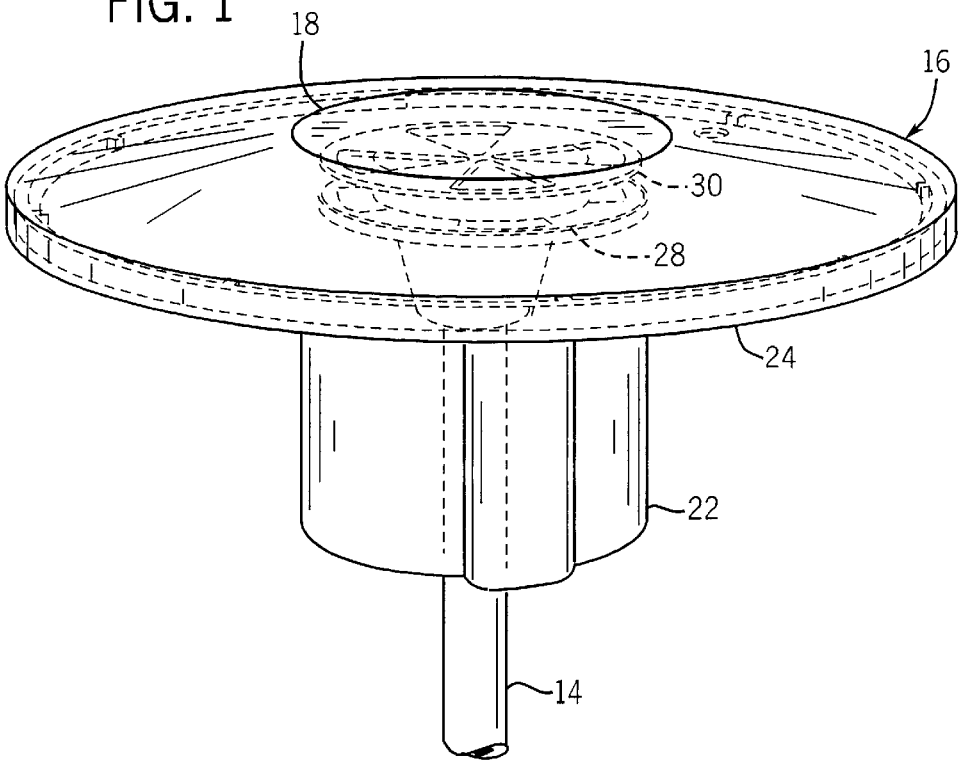
FIG. 1 is a perspective view of an antenna assembly of the present invention.

Referring now to the Figures, and more particularly to FIG. 1, an antenna assembly 10 provided for RF communication of signals representing utility meter data is shown. The antenna assembly 10 comprises a pair of conductors, here shown as conductive disks 28 and 30, separated by a dielectric 34 to form a capacitor. At least one of the disks 28 and 30 is moveable with respect to another one of the disks 28 and 30 to provide a variable capacitance for tuning the antenna. Signals indicative of utility metering data are received through a coaxial cable 14 and are radiated from the conductive disk 30 as described below.

Referring still to FIG. 1, the antenna assembly 10 can be enclosed in a plastic housing 16, comprising a cover 18 and a base 20. The base 20 further comprises a stem portion 22 and a disk-shaped cover support 24, and can also include brackets for retaining a transmitter (not shown). In use, the stem portion 22 of the antenna assembly 10 is inserted in a hole in a pit lid (not shown). The cover 18 and disk-shaped cover support 24 rest on the pit lid (not shown).

Figure 2:
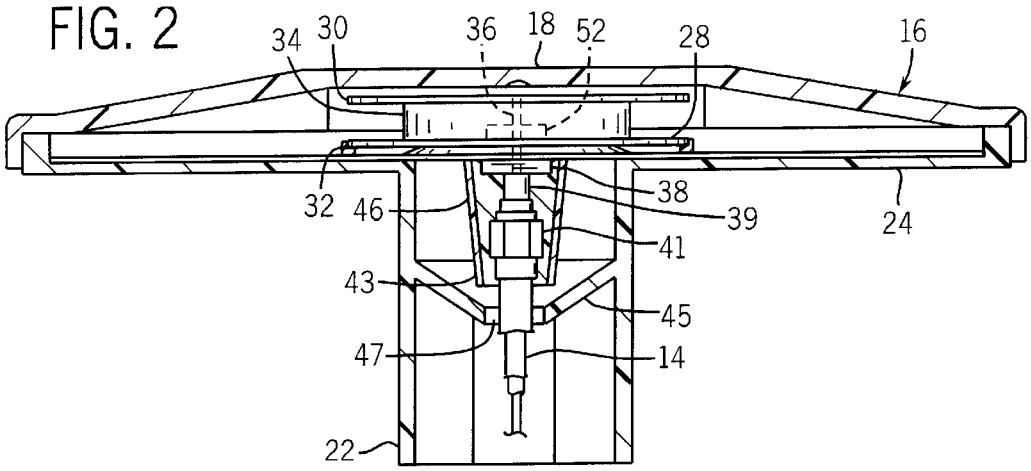
FIG. 2 is a side view in elevation of the antenna plate assembly of FIG. 1.

Referring now to FIG. 2, the antenna assembly 10 is shown coupled inside of the optional housing 16. The antenna assembly 10 comprises three planar conductors, in the form of conductive disks 26, 28, 30; a dielectric or non-conductive condutive spacing ring 32; a disk 34 of dielectric material; and a rigid center conductor 36, as will be described below.

The first conductive disk 26 forms a ground plane for the antenna, and preferably has a diameter greater than that of the second and third conductive disks. The second conductive disk 28 is separated from the first conductive disk by means of the non-conductive ring 32, providing a space 33 between the first and second conductive disks 26 and 28, respectively. The non-conductive ring 32 can comprise any of a number of materials, but preferably comprises a non-conductive plastic. The space 33 defined by the non-conductive spacer ring 32 provides a dielectric between the first and second conductive disks 26 and 28 to form a capacitance as described below. It will be apparent that other dielectrics can also be used.

The disk 34 of dielectric material is disposed on the second conductive disk 28, providing a dielectric separation between the second conductive disk 28 and the third conductive disk 30, at least a portion of which provides the function of the radiating or antenna element. Each of the first, second and third conductive disks 26, 28 and 30 preferably comprise a stamped copper plate, although other conductive materials, and particularly copper alloys and brass, can also be used. The disk 34 preferably comprises a machined or molded dielectric element, constructed of a polysulphone material, although other material known to those of skill in the art can also be used. As described below, the size of the dielectric material can be varied to change the overall capacitance provided.

The rigid center conductor 36 is threaded through a center aperture, (not shown) in each of the first, second and third conductive disks 26, 28 and 30, respectively. The center conductor 36 is further coupled to the coaxial cable 14 with a coaxial cable connector 38, threaded sleeve 39 and hex-sided collar 41. The coaxial cable connector 38 is enclosed in a tapered sleeve 43 and surrounded by an encapsulating material 46, which is allowed to solidify around the connection. A funnel-shaped web 45 having a hole 47 through which the coaxial cable 14 extends further supports the coaxial cable 14 to prevent disruption of service. A shield or ground portion of the coaxial cable 14 is coupled to the first conductor 26 or ground plane.

Figure 3:
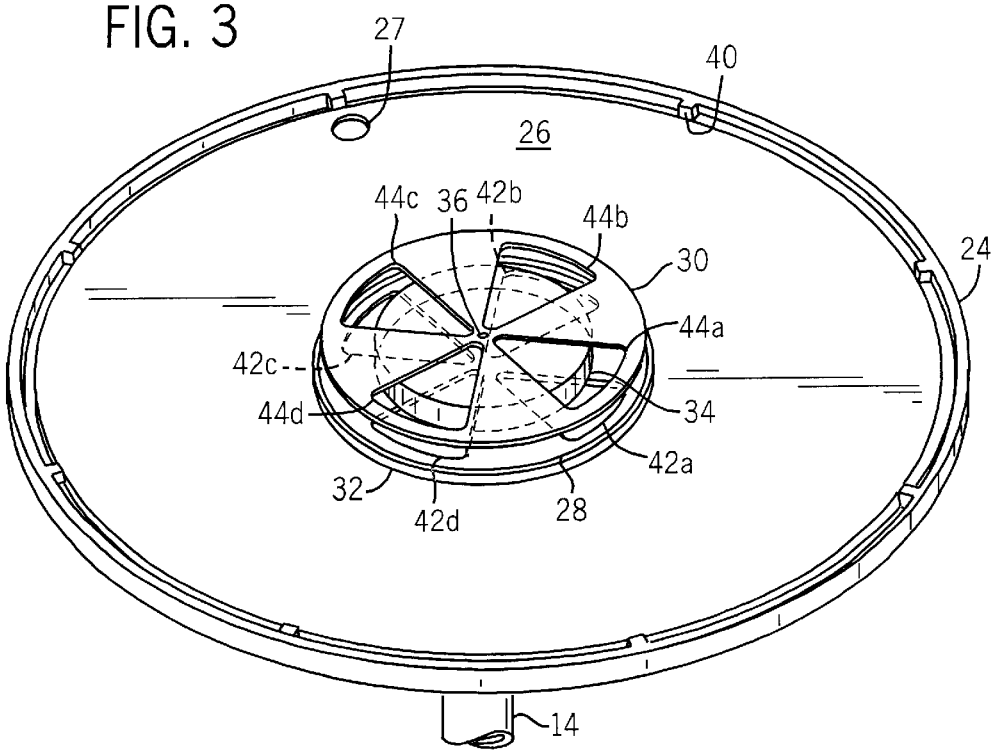
FIG. 3 is a perspective view of the antenna assembly of FIG. 1 with parts removed for a better view.
Figure 4:
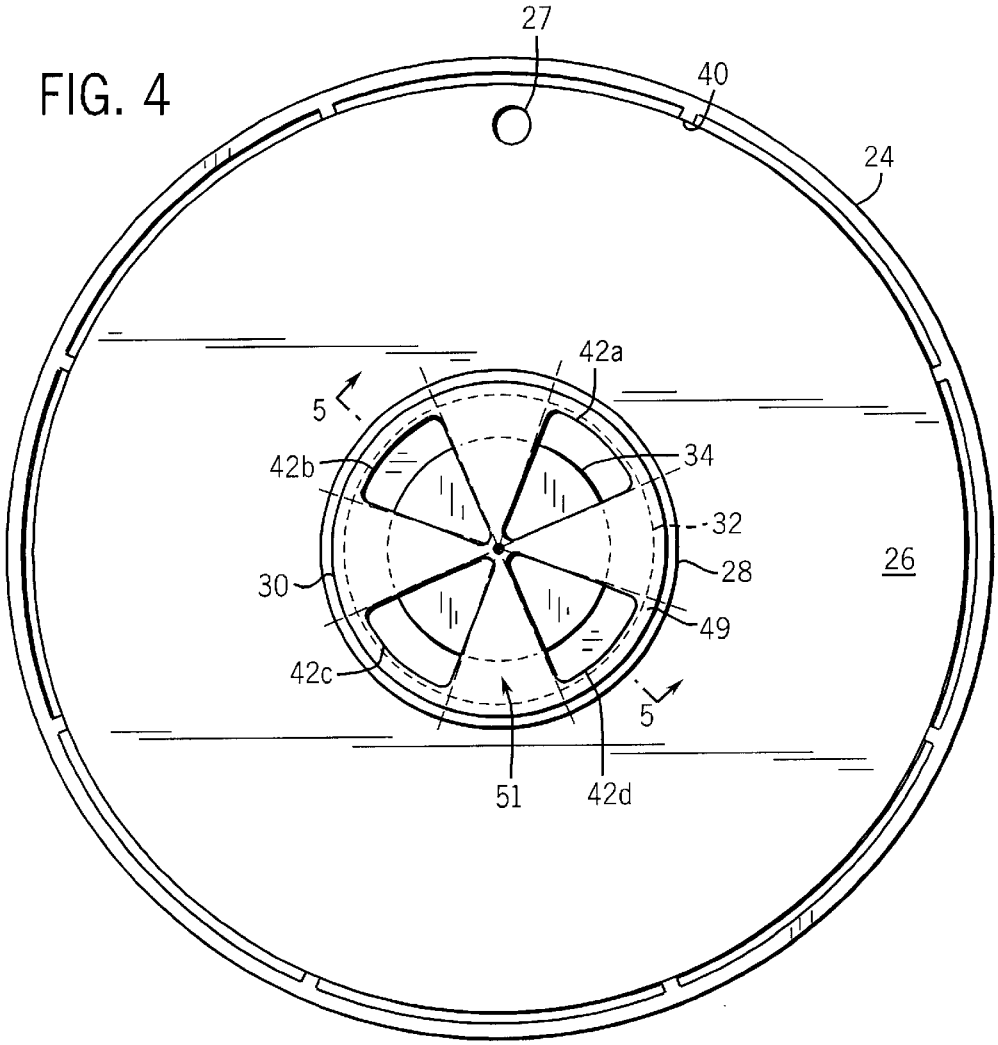
FIG. 4 is a top plan view of the assembly of FIG. 2.

Referring now to FIGS. 3 and 4, the disk-shaped cover support 24 includes a plurality of axially extending projections 40 for retaining the first conductive disk 26 in the housing 16, thereby forming the ground plane. An aperture 27 is defined in the first conductive disk for manufacturing purposes. The second conductive disk 28 and third conductive disk 30, each include a plurality of apertures 42 and 44, respectively, used to vary capacitance as will be described more fully below.

The apertures 42 and 44 are formed by cutting, stamping, or otherwise removing four equal cut-out sectors from the disks 28 and 30, which are alternated with four equal conductive sectors of solid conductive material. Referring specifically to FIG. 4, the disk 30 can be viewed as comprising eight forty-five degree sectors, four "cut-out" sectors 49 and four "conductive" sectors 51. In each of the cut-out sectors 49, conductive material is removed from the sector 49 to form an aperture 44. Each apertures 44 starts at a point offset from the center of the disk by a predetermined distance and extends to a point offset from the outer diameter the disk by a second predetermined distance. Therefore a conductive framework is maintained around the apertures 44 in each of the cut-out sectors 49. This configuration allows a significant amount of material to be removed from the disks while providing a wide range of capacitance and still maintaining the structural integrity of the disk. Furthermore, the apertures are arranged symmetrically to provide a symmetrical radiation pattern from the radiating element or third conductive disk 30. Other aperture shapes, sizes and arrangements will be apparent to those of ordinary skill in the art. Furthermore, it will be apparent that the apertures can be formed by removing material by means of a cutting or stamping operation, or can be cast or molded into the respective disk.

Figure 5:
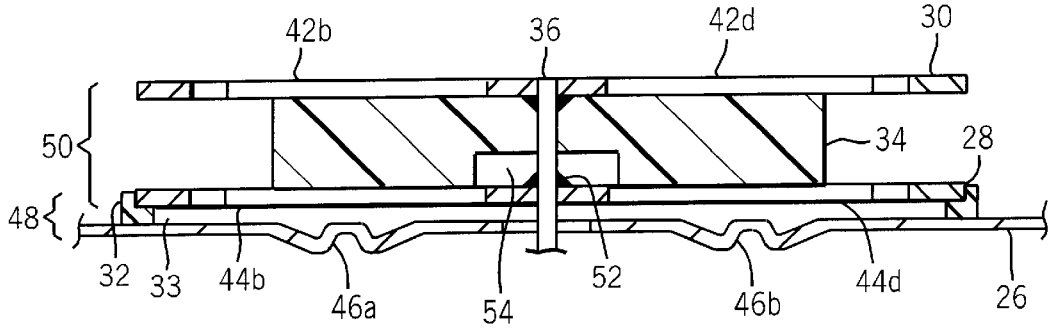
FIG. 5 is a sectional view of the antenna assembly taken in the plane identified by line 5—5 in FIG. 4.

Referring now to FIG. 5, a detailed view of the stacked conductive disks 26, 28 and 30 is shown. The first conductive disk 26 can include a circular ridge, here shown as ridges 46*a* and 46*b* in the ground plane for retaining the tapered sleeve 43 described above. The second conductive disk 28 is disposed on the spacer ring 32 and therefore is separated from the ground plane 26 by a space 33 defined basically by the height of the spacer ring 32. The first and second conductive disks 26 and 28 thereby form a first capacitance 48 which acts as a shunt capacitor for the antenna assembly 10, with air in the space 33 providing a dielectric.

As noted above, disposed on the second conductive disk 28 is the disk 34 of dielectric material. The disk 34 preferably includes an aperture 54 encircling the connection point between the center conductor 36 and second conductive disk 26 to prevent interference with the solder joint 52, described more fully below. The diameter of the dielectric 34 is selected to provide an operating frequency in conjunction with the tuning of the capacitors as described below.

The third conductive disk 30 is disposed on the dielectric 34, thereby forming a second capacitor 50 comprising the second conductive disk 28 and third conductive disk 30. The third conductive disk 30 is rotatable around the rigid center conductor 36 to vary the alignment of the apertures 42*a–d* and 44*a–d* in each of the disks 28 and 30, thereby varying the capacitance provided by the capacitor 50, and allowing the antenna assembly 10 to be tuned to an operating or resonant frequency. In tuning the antenna assembly 10, the parallel capacitors 48 and 50 combine to provide the overall capacitance of the circuit.

The center conductor 36 is selected to provide an inductive element to the antenna circuit, and the capacitors 48 and 50 are selected to provide a capacitance which when cascaded with the inductance substantially matches an output impedance of the transmitter for maximum power transfer to the radiating element or third conductive disk 30. The driving impedance of the radiating element or third conductive disk 30 at resonance is very low typically in the range of about 1 ohm to about 3 ohms.

In operation, the first conductive disk 26 or ground plane is a radial transmission wire and has a diameter selected such that the ground plane operates in an anti-resonant mode, in which a voltage minimum occurs at its periphery.

The antenna assembly 10 is initially assembled by soldering the second conductive disk 28 to the center conductor 36, forming the solder joint 52. The dielectric 34 is then assembled onto the second conductive disk 28, and the third conductive disk 30 is assembled onto the dielectric 34. The antenna assembly 10 is then tested to determine the radiating frequency, and the third conductive disk 30 is rotated to vary the capacitance or "tune" the antenna assembly 10 to a resonant frequency by modifying the alignment of the apertures 42 with the apertures 44, wherein the highest frequency is obtained by aligning the metal area of one of the disks 28 or 30 over the open area of another of the disks 28 or 30. After the antenna assembly 10 is tuned to the selected frequency level, the conductive disk 30 is fastened in place. A second solder joint 56 can be used. Other fastening means including conductive adhesives, fastening devices, and welding can also be used. The apertures 42 and 44 assist in the soldering operation by localizing heat at the center of the respective conductive disks 28 and 30.

The radiating element or third conductive disk 30 is designed for a transmitter operating frequency in the range of 902–928 MHz approved by the FCC for this type of equipment, preferably operating at 915 MHz. It should be apparent that, as a technical matter, operating frequencies outside this range can be employed including frequencies in the microwave or in UHF range of frequencies. Furthermore, the antenna assembly 10 can be constructed to provide any number of frequencies, and in particular frequencies between 820 MHz and 1.2 GHz.

Figure 6:
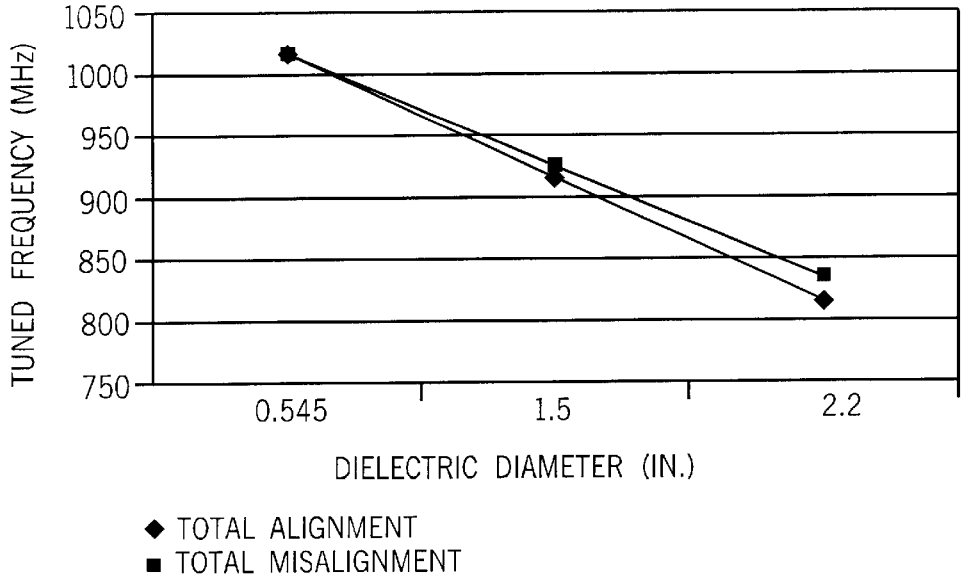
FIG. 6 is a graph of frequency vs. diameter of the capacitor as a function of misalignment showing adjustability of frequency based on misalignment.

Referring now to FIG. 6, the apertures 42*a–d* and 44*a–d* are used to vary the resonant frequency of the antenna, depending on the alignment or misalignment of the apertures 42 with the apertures 44, and on the size and type of dielectric material 34 used in the antenna assembly 10. Here, by choosing combinations of the diameter of the dielectric 34 and alignment of the disks 28 and 30, the tunable range of the antenna assembly 10 is 200 MHz. Near 915 MHz, the tunable range using a single dielectric diameter, is 10 MHz.

In the tests shown in FIG. 6, the dielectric material selected was polysulphone, which has a dielectric constant three times that of air. When using a dielectric material 34 having a diameter of 2.2 inches, the radiating element 30 radiates at a frequency of 818 MHz when the apertures 42 and 44 are aligned, and 834 MHz when the apertures are fully misaligned. For a dielectric material 34 having a radius of 0.545 inches, the gap is mostly air, and the tunable range is smaller. Here, the frequency ranged from 1016 to 1018 MHz. In either case, any frequency in the range can be achieved by aligning the apertures 42 and 44 to an appropriate level.

The present invention provides a low cost antenna tunable over a wide range of frequencies. The invention minimizes manufacturing cost and waste by allowing the antenna to be "tuned" even where parts are provided within a fairly wide tolerance range. Furthermore, an antenna assembly constructed in accordance with the present invention can be adjusted and re-tuned to an operating frequency in the field, thereby allowing for applications of an antenna in a number of different installations.

This has been a description of the preferred embodiments of the method and apparatus of the present invention. Those of ordinary skill in this art will recognize that modifications might be made while still coming within the spirit and scope of the invention and, therefore, to define the embodiments of the invention, the following claims are made.

We claim:

1. An antenna assembly for RF communication of signals representing utility meter data, the antenna assembly comprising:

a first conductor of a capacitor comprising a planar metal sheet material including conductive portions and non-conductive portions;

a second conductor of the capacitor including conductive portions and non-conductive portions, said second conductor being spaced from the first conductor;

a spacer of dielectric material disposed between said first conductor and said second conductor, wherein said first conductor and said second conductor form a tuning capacitor in which a dielectric layer is provided by the spacer and by an air space disposed between said first conductor and said second conductor; and an inductance in cascade with the capacitor to provide a selected L-C circuit impedance in relation to an antenna radiating element; and wherein the conductive and non-conductive portions of the first conductor are positioned in relation to the conductive and non-conductive portions of the second conductor to select a capacitance of the L-C circuit that provides a selected frequency of operation; and wherein the first conductor of the capacitor is also the antenna radiating element.

2. The antenna assembly as defined in claim 1, wherein the non-conductive portions of said first conductor and said second conductor each include a plurality of apertures alternating with the conductive portions of conductive material, and wherein a misalignment of the apertures in the respective conductors selects the capacitance of the tuning capacitor to tune the L-C circuit.

3. The antenna assembly of claim 2, wherein the apertures in the first conductor and the second conductor are formed as 45-degree sectors alternated with 45-degree sectors of conductive material forming the first conductor and the second conductor.

4. The antenna assembly of claim 1, further comprising a ground plane conductor disposed a spaced distance below the first conductor and the second conductor and electrically connected thereto.

5. The antenna assembly of claim 4, wherein the inductance is formed by a rigid conductor which electrically connects the ground plane to the first conductor and the second conductor.

6. The antenna assembly of claim 4, further comprising a dielectric disposed between the ground plane and the second conductor.

7. The antenna assembly of claim 5, wherein the dielectric comprises a space filled with air between the ground plane and the second conductor.

8. The antenna assembly of claim 5, further comprising a coaxial connector electrically coupled to the rigid conductor.

9. The antenna assembly of claim 2, wherein the apertures are arranged symmetrically with respect to two orthogonal directions across each of the first and second conductors.

10. The antenna assembly as defined in claim 1, characterized in that the first and second conductors are formed of copper or a copper alloy.

11. The antenna assembly as defined in claim 1, further comprising a housing of plastic material enclosing said antenna assembly.

12. The antenna assembly as defined in claim 1, wherein the diameter of the spacer of dielectric material is selected to correspond to a capacitance to tune the antenna assembly to a nominal frequency in a range from about 820 MHz to about 1.2 GHz; and wherein said tuning capacitor is operable, during assembly of the antenna assembly, to tune said nominal frequency within said range to a final operating frequency.

13. The antenna assembly as defined in claim 1, wherein the diameter of the spacer of dielectric material is selected to provide a capacitance to tune the antenna assembly to a nominal operating frequency in a frequency range including 915 MHz; and wherein said tuning capacitor is operable, during assembly of the antenna assembly, to tune said frequency within the range to substantially 915 MHz.

14. The antenna assembly as defined in claim 13, wherein the dielectric material of the spacer comprises a polysulphone material.

15. A method of making an antenna which is tunable to a desired operating frequency, the method comprising:

providing a first conductor, a second conductor and a dielectric spacing element, wherein said first conductor, said second conductor and said dielectric spacing element form a capacitor; and assembling said capacitor in cascade with an inductance to provide a selected L-C circuit impedance in relation to the first conductor;

wherein said first conductor forms at least a portion of an antenna radiating element; and positioning said antenna radiating element relative to a position of said second conductor, such that the capacitance of the L-C circuit is adjusted to tune the L-C circuit to a selected frequency of operation.

16. The method of claim 15, further comprising selecting a diameter of the dielectric spacing element to select a range of frequency operation, and wherein said antenna element is positioned to tune the antenna assembly to a selected frequency within the range of frequency operation determined by the diameter of the dielectric spacing element.

17. The method of claim 16, wherein the selected frequency within the range of frequency operation is substantially 915 MHz.

18. The method of claim 16, wherein the spacing element is a disc of a synthetic material which is formed to a diameter in a range from 0.545 inches to 2.2 inches, inclusive.

19. The method of claim 18, wherein the spacing element is formed by molding a polysulphone material.

20. The method of claim 16, wherein the non-conductive portions of the antenna radiating element are formed as apertures in a planar metal sheet material.

21. The method of claim 20, wherein the apertures in the antenna radiating element are 45-degree sectors alternated with 45-degree sectors of, conductive material.

22. The method of claim 21, wherein the 45-degree sector apertures are alternated with 45-degree sectors of conductive material in four quadrants of the antenna radiating element and of the second conductor, so as to provide a symmetrical pattern of the 45-degree sector apertures and 45-degree sectors of conductive material with respect to two orthogonal directions.

23. The method of claim 22, wherein said positioning includes rotating the antenna radiating element in relation to the second conductor, and the method further comprising fastening the antenna radiating element in a final position.

24. The method of claim 23, wherein the fastening is accomplished by soldering, applying conductive adhesives, applying fastening devices or welding.

* * * * *

UNITED STATES PATENT AND TRADEMARK OFFICE

CERTIFICATE OF CORRECTION

PATENT NO. : 6,606,070 B2
DATED : August 12, 2003
INVENTOR(S) : John A. Olson et al.

It is certified that error appears in the above-identified patent and that said Letters Patent is hereby corrected as shown below:

Column 3,
Line 2, delete “conductive.”.
Lines 65-66, “diameter the” should be -- diameter of the --.

Signed and Sealed this

Twenty-fourth Day of February, 2004

JON W. DUDAS
*Acting Director of the United States Patent and Trademark Office*